US012103133B2

(12) United States Patent
Huang et al.

(10) Patent No.: US 12,103,133 B2
(45) Date of Patent: Oct. 1, 2024

(54) CHEMICAL-MECHANICAL POLISHING APPARATUS

(71) Applicant: Taiwan Semiconductor Manufacturing Co., Ltd., Hsin-Chu (TW)

(72) Inventors: Chun-Hsi Huang, Hsinchu (TW); Huang-Chu Ko, Miaoli County (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 0 days.

(21) Appl. No.: 18/198,727

(22) Filed: May 17, 2023

(65) Prior Publication Data

US 2023/0286106 A1 Sep. 14, 2023

Related U.S. Application Data

(63) Continuation of application No. 17/405,933, filed on Aug. 18, 2021, now Pat. No. 11,679,467, which is a (Continued)

(51) Int. Cl.
*B24B 37/015* (2012.01)
*B24B 37/04* (2012.01)
(Continued)

(52) U.S. Cl.
CPC ..... *B24B 37/015* (2013.01); *B24B 37/042* (2013.01); *B24B 37/107* (2013.01);
(Continued)

(58) Field of Classification Search
CPC ..... B24B 37/015; B24B 37/042; B24B 49/14; B24B 55/02; B24B 57/02
(Continued)

(56) References Cited

U.S. PATENT DOCUMENTS 5,478,435 A * 12/1995 Murphy ..... H01L 21/6715 438/693
5,957,750 A * 9/1999 Brunelli ..... B24B 49/14 451/21
(Continued)

FOREIGN PATENT DOCUMENTS

JP 2008093742 A 4/2008
JP 2013219133 A 10/2013
KR 20170068534 A 6/2017

OTHER PUBLICATIONS

Official Action issued Feb. 15, 2019, in corresponding Taiwan Patent Application No. 10820109390.

*Primary Examiner* — Eileen P Morgan
(74) *Attorney, Agent, or Firm* — Duane Morris LLP

(57) ABSTRACT

An apparatus for performing a polishing process includes: a rotatable polishing pad; a temperature sensor configured to monitor a temperature on a top surface of the rotatable polishing pad; a first dispenser configured to dispense a first slurry that is maintained at a first temperature on the rotatable polishing pad; and a second dispenser configured to dispense a second slurry that is maintained at a second temperature on the rotatable polishing pad, wherein the second temperature is different from the first temperature so as to maintain the temperature on the top surface of the rotatable polishing pad at a substantially constant value.

20 Claims, 4 Drawing Sheets

Related U.S. Application Data continuation of application No. 15/901,796, filed on Feb. 21, 2018, now Pat. No. 11,103,970.

(60) Provisional application No. 62/545,666, filed on Aug. 15, 2017.

(51) Int. Cl.

| | |
|---|---|
| ***B24B 37/10*** | (2012.01) |
| ***B24B 49/14*** | (2006.01) |
| ***B24B 55/02*** | (2006.01) |
| ***B24B 57/02*** | (2006.01) |
| *B24B 37/30* | (2012.01) |

(52) U.S. Cl.
CPC ..... *B24B 49/14* (2013.01); *B24B 55/02* (2013.01); *B24B 57/02* (2013.01); *B24B 37/30* (2013.01)

(58) Field of Classification Search
USPC ..... 451/7, 36, 53, 285, 287
See application file for complete search history.

(56) References Cited

U.S. PATENT DOCUMENTS 6,315,635 B1 * 11/2001 Lin ..... B24B 57/02 451/7
6,953,750 B1 * 10/2005 Wu ..... B24B 57/02 438/692
7,201,634 B1 * 4/2007 Naujok ..... B24B 37/015 451/7
8,439,723 B2 * 5/2013 Marks ..... B24B 37/015 451/7
8,622,783 B2 * 1/2014 Kiesel ..... B24B 57/02 451/36
9,550,270 B2 * 1/2017 Hung ..... B24B 37/015
10,160,090 B2 * 12/2018 Cheng ..... B24B 57/02
2001/0055940 A1 * 12/2001 Swanson ..... B24B 37/015 451/53
2003/0051035 A1 * 3/2003 Hsu ..... B24B 57/02 709/226
2003/0119427 A1 * 6/2003 Misra ..... B24B 53/017 451/41
2005/0048875 A1 * 3/2005 Koo ..... B24B 49/10 451/7
2007/0093064 A1 * 4/2007 Fukushima ..... H01L 21/3212 438/692
2010/0151771 A1 * 6/2010 Nabeya ..... B24B 37/015 451/7
2011/0159782 A1 * 6/2011 Sone ..... B24B 37/015 451/7
2013/0045596 A1 * 2/2013 Eda ..... B24B 37/042 438/692
2013/0115855 A1 * 5/2013 Kodera ..... B24B 37/044 451/7
2013/0331004 A1 * 12/2013 Minamihaba ..... B24B 37/26 451/53
2015/0004878 A1 * 1/2015 Matsui ..... B24B 37/015 451/41
2016/0099156 A1 * 4/2016 Yamaguchi ..... B24B 53/017 438/692
2016/0101500 A1 4/2016 Fung et al.
2019/0054590 A1 * 2/2019 Huang ..... B24B 49/14
2019/0091828 A1 * 3/2019 Jeong ..... B24B 49/14
2023/0219187 A1 * 7/2023 Kabasawa ..... B24B 49/14 451/7

* cited by examiner

CHEMICAL-MECHANICAL POLISHING APPARATUS

CROSS-REFERENCE TO RELATED APPLICATION

This application is a continuation of U.S. patent application Ser. No. 17/405,933, filed Aug. 18, 2021, which is a continuation of U.S. patent application Ser. No. 15/901,796, filed Feb. 21, 2018, now U.S. Pat. No. 11,103,970, which claims priority to U.S. Provisional Patent Application No. 62/545,666, filed on Aug. 15, 2017, each of which are incorporated by reference herein in their entireties.

BACKGROUND

In general, a chemical mechanical polishing, or planarization, (CMP) process has been used for polishing a top face, or a device side, of a wafer during fabrication of a semiconductor device on the wafer. The wafer is "planarized" or smoothed one or more times in order for the top surface, or device side, of the wafer to be as flat as possible.

Typically, the CMP process involves holding and rotating a wafer of one or more materials against a wetted surface of a polishing pad under controlled chemical, pressure, and temperature conditions. A chemical slurry containing a polishing agent (also referred to as a "polishing slurry"), such as alumina or silica, is used as an abrasive material. Additionally, the chemical slurry contains selected chemicals which etch various surfaces of the wafer during the CMP process. Such a combination of mechanical and chemical removal of material during the CMP process allows the polished surface to be optimally planarized, e.g., removing a substantial amount of materials above the polished surface while remaining various device features formed below the polished surface substantially intact. Among the above-mentioned conditions, the temperature is typically considered as one of the most decisive factors to reach such an end.

In particular, the temperature may be referred to as the temperature on the surface of the polishing pad (hereinafter "pad temperature"). Although when the pad temperature is increased, a polishing rate can be accordingly increased, which increases throughput (i.e., reducing cost), various defects (e.g., corrosion/dishing effects) can be also formed on the polished surface. On the other hand, when the pad temperature is decreased, the polishing rate is accordingly decreased, which may require the use of additional chemical slurries. In turn, the cost may be significantly increased. Thus, it is generally desirable to perform the CMP process under an optimal temperature, and such an optimal temperature is desired to remain substantially constant.

To maintain the pad temperature substantially constant, the existing CMP apparatus (i.e., the equipment performing the CMP process) generally relies on dispensing only one chemical slurry controlled at a first temperature onto a polishing pad, and based on variation of temperature of the polishing pad (e.g., pad temperature), adjusting the first temperature of the chemical slurry. Such a technique may cause additional defects on a polished surface partially because of a delay induced while adjusting the first temperature of the only one chemical slurry. Therefore, existing CMP apparatuses are not entirely satisfactory.

BRIEF DESCRIPTION OF THE DRAWINGS

Aspects of the present disclosure are best understood from the following detailed description when read with the accompanying figures. It is noted that various features are not necessarily drawn to scale. In fact, the dimensions and geometries of the various features may be arbitrarily increased or reduced for clarity of illustration.

DETAILED DESCRIPTION OF EXEMPLARY EMBODIMENTS

Figure 1A:
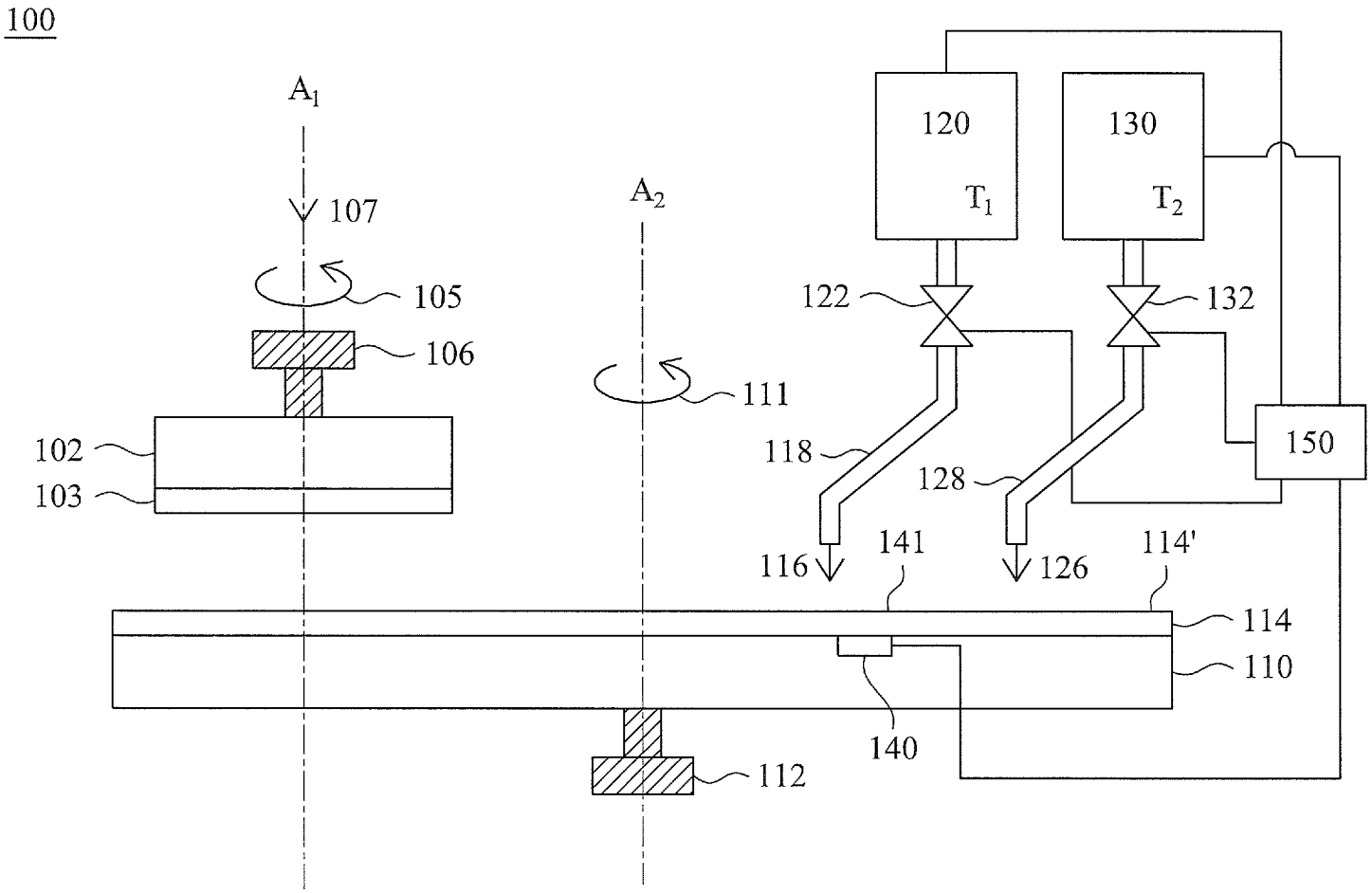
FIG. 1A illustrates a cross-sectional view of a chemical mechanical polishing (CMP) apparatus, in accordance with some embodiments.

The following disclosure describes various exemplary embodiments for implementing different features of the subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

The present disclosure provides various embodiments of a CMP (chemical mechanical polishing) apparatus including at least two polishing slurries that are maintained at respective different temperatures. In some embodiments, the at least two polishing slurries, maintained at two different temperatures, are concurrently dispensed, but at respective different flow rates, onto a polishing pad of the CMP apparatus while performing a CMP process. Moreover, in some embodiments, such respective different flow rates of the at least two polishing slurries are determined based on a continuously monitored temperature of the polishing pad. As such, in some embodiments, the temperature of the polishing pad can be precisely and responsively maintained at a pre-defined constant value, which may substantially eliminate the above-mentioned issues observed in existing CMP apparatuses.

Figure 1B:
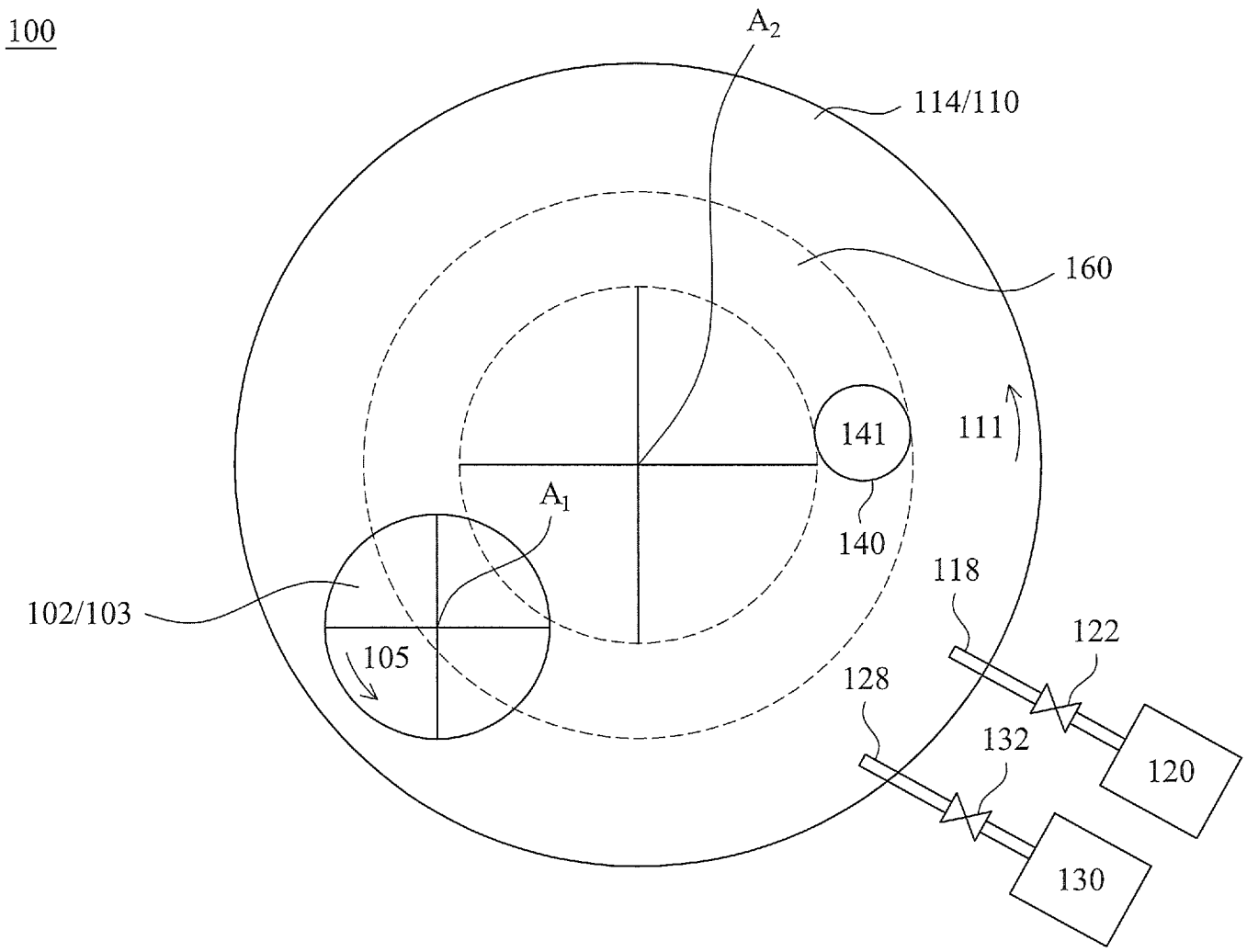
FIG. 1B illustrates a corresponding top view of the CMP apparatus of FIG. 1A, in accordance with some embodiments.

FIG. 1A schematically illustrates a cross-sectional view of a chemical mechanical polishing (CMP) apparatus 100, in accordance with various embodiments of the present disclosure, and FIG. 1B illustrates a corresponding top view of the CMP apparatus 100. It is noted that the CMP apparatus 100, shown in the illustrated embodiment of FIGS. 1A and 1B, is simplified for a better understanding of the concepts of the present disclosure. Thus, the CMP apparatus 100 may include one or more additional components (e.g., a pad conditioner, additional conduits, etc.), which are not shown in FIGS. 1A-1B, while remaining within the scope of the present disclosure.

As shown in FIG. 1A, the CMP apparatus 100 includes a sample carrier (or a polishing head) 102 configured to hold a sample 103 (e.g., a semiconductor wafer) to be polished. In some embodiments, the sample carrier 102 is mounted for continuous rotation about axis, A1, in a direction indicated by arrow 105, and such a continuous rotation may be actuated by a drive motor 106. Further, the sample carrier 102 is adapted so that a force 107 can be exerted on the sample 103 to keep it held. The CMP apparatus 100 also includes a polishing platen 110 mounted for continuous rotation about axis, A2, in a direction indicated by arrow 111, and such a continuous rotation is actuated by a drive motor 112. Over the polishing platen 110, a polishing pad 114, formed of a material such as blown polyurethane, is mounted. As such, the polishing pad 114 may rotate in accordance with the polishing platen 110, i.e., a rotatable pad.

Further, in some embodiments, when the sample 103 is held, by the sample carrier 102, against a top surface 114' of the polishing pad 114 and the sample 103 and polishing pad 114 rotate at respective speeds (which will be discussed below), a first polishing slurry 116 containing an abrasive fluid, such as silica or alumina abrasive particles suspended in either a basic or an acidic solution, is dispensed onto the top surface 114' of the polishing pad 114; and concurrently or subsequently, a second polishing slurry 126 containing the same abrasive fluid is also dispensed onto the top surface 114' of the polishing pad 114.

More specifically, in some embodiments, the first polishing slurry 116 is dispended onto the polishing pad 114 through a conduit 118 and from a reservoir 120, and a flow rate of the first polishing slurry 116 is adjusted by a valve 122 coupled to the conduit 118; and the second polishing slurry 126 is dispended onto the polishing pad 114 through a conduit 128 and from a reservoir 130, and a flow rate of the second polishing slurry 126 is adjusted by a valve 128 coupled to the conduit 128. In other words, volumes (e.g., milliliters) of the first polishing slurry 116 and second polishing slurry 126 dispensed onto the polishing pad 114 over a period of time are respectively adjusted by the valves 122 and 132. In some embodiments, the conduit 118 and the corresponding valve 122 may be collectively referred to as a first dispenser; and the conduit 128 and the corresponding valve 132 may be collectively referred to as a second dispenser. Although in the illustrated embodiment of FIG. 1A, the valves 122 and 132, configured to adjust the flow rates of the first and second polishing slurries 116 and 126, are respectively coupled to the conduits 118 and 128, it is noted that in some other embodiments, the valves 122 and 132 may be placed in other locations (e.g., coupled between the respective reservoirs 120/130 and a draining pipe (not shown) so as to allow the adjustment of the flow rates of the first and second polishing slurries 116 and 126) while remaining within the scope of the present disclosure.

Moreover, according to some embodiments, although the first polishing slurry 116 and second polishing slurry 126 contain the same abrasive fluid, the first polishing slurry 116 and the second polishing slurry 126 may be at respective different temperatures "T1" and "T2." In some embodiments, the reservoir 120, containing the first polishing slurry 116, is maintained at the temperature T1; and the reservoir 130, containing the second polishing slurry 126, is maintained at the temperature T2, wherein T1 is higher than T2, for example.

In some embodiments, a temperature sensor 140 (e.g., an infrared radiation detection device, etc.) may be coupled to the polishing pad 114 at an area 141 of the top surface 114'. In some embodiments, such an area 141 may be located along a traveling path of the sample carrier 102 (and the to-be polished sample 103), which will be discussed in further detail below. Although in the illustrated embodiment of FIG. 1A, the temperature sensor 140 is shown as being coupled to the polishing pad 114, it is noted that in some other embodiments, the temperature sensor 140 may be detached from (e.g., suspended from) the top surface 114' of the polishing pad 114 while remaining within the scope of the present disclosure. Moreover, although only one temperature sensor 140 is shown in FIG. 1A, it is noted that one or more temperature sensors, each of which is substantially similar to the temperature sensor 140, may be included in the CMP apparatus 100 (e.g., coupled to or suspended from the polishing pad 114).

Referring still to FIG. 1A, in some embodiments, the CMP apparatus 100 includes a controller 150 coupled to the reservoirs 120 and 130, the valves 122 and 132, and the temperature sensor 140. In some embodiments, the controller 150 may be configured to control the valves 122 and 132 so as to adjust respective flow rates of the first and second slurries 116 and 126, and/or the respective temperatures T1 and T2 of the reservoirs 120 and 130 based on a monitored temperature of the polishing pad 114, which will be discussed in further detail below.

Referring now to FIG. 1B, the corresponding top view of part of the CMP apparatus 100 is shown, in accordance with various embodiments of the present disclosure. As mentioned above, the sample carrier 102 (carrying the sample 103) rotates about the axis A1 in the direction 105; and the polishing platen 110 (carrying the polishing pad 114) rotates about the axis A2 in the direction 111, wherein the directions 105 and 111 may be identical to or different from each other. Accordingly, a traveling path 160 of the sample 103, which may be in a shape of an annular ring as shown in the illustrated embodiment of FIG. 1B, is formed on the top surface 114' of the polishing pad 114. In some embodiments, the area 141 in which the at least one temperature sensor 140 is disposed is located along such a traveling path 160 of the sample carrier 102/sample 103. As such, the temperature of a portion of the top surface 114' of the polishing pad 114 (hereinafter "pad temperature") where the sample 103 is polished can be precisely monitored by the temperature sensor 140 and moreover, corresponding response can be determined by the coupled controller 150, which will be discussed in further detail below.

Figure 2:
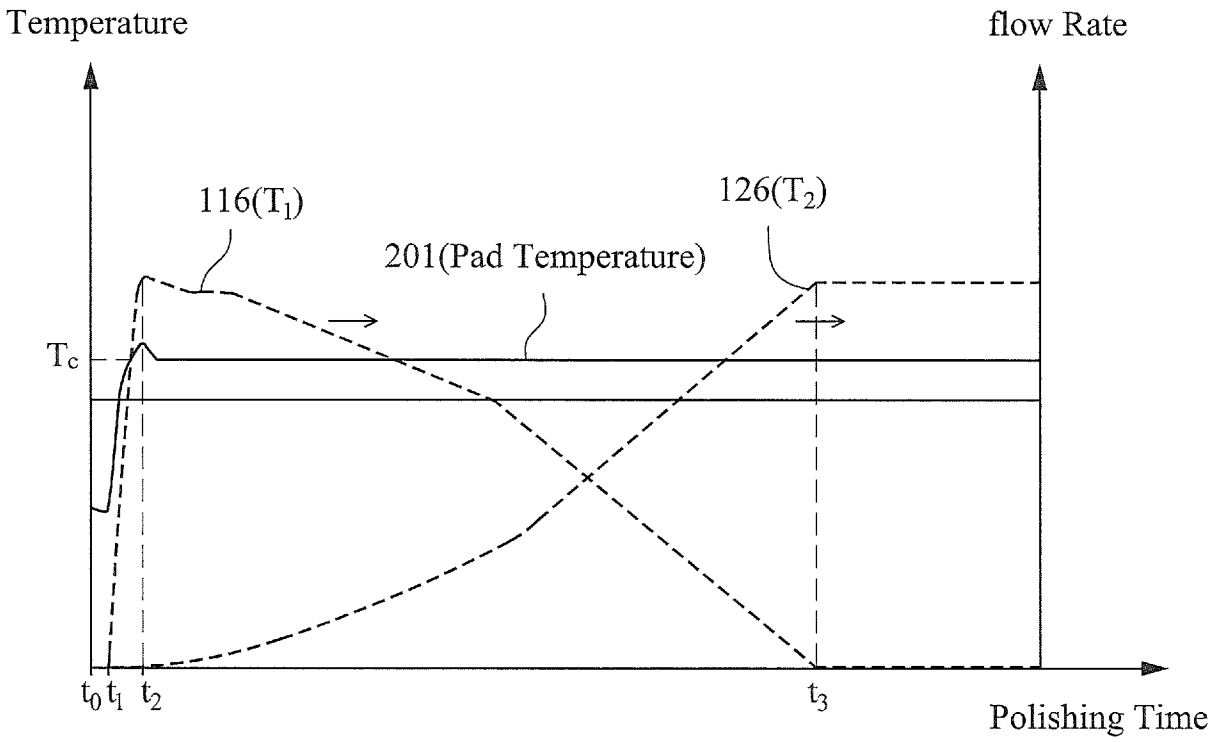
FIG. 2 illustrate an exemplary behavior of a pad temperature in accordance with respective flow rates of a first polishing slurry and a second polishing slurry over polishing time while operating the CMP apparatus of FIGS. 1A-1B, in accordance with some embodiments.

As mentioned above, the disclosed CMP apparatus 100 is configured to dynamically (e.g., concurrently) adjust the flow rates of the first and second polishing slurries 116 and 126 so as to maintain the pad temperature at a substantially constant value. FIG. 2 illustrates an exemplary behavior of the pad temperature (hereinafter "pad temperature 201") in accordance with respective flow rates of the first polishing slurry 116 and second polishing slurry 126 over polishing time. In particular, the X axis of FIG. 2 represents the polishing time; the left Y axis of FIG. 2 represents the temperature; and the right Y axis of FIG. 2 represents the flow rate of each of the first/second polishing slurries 116/126. In some embodiments, the substantially constant value of the pad temperature "Tc" may be pre-determined, and during a CMP process, the pad temperature 201 is controlled, by the CMP apparatus 100, to maintain around such a constant value Tc. In the following discussion of using the CMP apparatus 100 to perform the CMP process while keeping the pad temperature 201 at the constant value Tc, FIGS. 1A-2 will be concurrently used.

In some embodiments, at time "t0," the sample 103 is held by the sample carrier 102 with a to-be polished surface facing down against the top surface 114' of the polishing pad 114. A speed of the drive motor 112, to rotate the polishing platen 114, is set at about 30 to 80 rpm, for example, and a speed of the drive motor 106, to rotate the sample carrier 102, is set at about 5 to 30 rpm, for example. Moreover, the sample carrier 102 is set to apply a pressure of about 6 to 12 psi between the sample 103 and the polishing pad 114, through the application of force 107. As such, the sample 103 and the polishing pad 114 may rotate in accordance with the sample carrier 102 and the polishing platen 110, respectively. In some embodiments, at time t0, neither the first polishing slurry 116 nor the second polishing slurry 126 is dispended onto the polishing pad 114. Thus, the pad temperature 201 may be substantially lower than the constant value Tc.

Subsequently, at time "t1," while keeping the sample 103 and polishing pad 114 rotating at respective speeds, the first polishing slurry 116, which is maintained at the higher temperature T1, is dispensed onto the polishing pad 114 through the conduit 118 to saturate the polishing pad 114. More specifically, as shown in the illustrated embodiment of FIG. 2, the flow rate of the first polishing slurry 116 is gradually increased, which is adjusted by the valve 122. Accordingly, in the presence of the first polishing slurry 116 between the rotating sample 103 and polishing pad 114, the CMP process may be started and the pad temperature 201 is gradually increased. In some embodiments, the pad temperature 201 is continuously monitored by the temperature sensor 140, and the monitored pad temperature is continuously reported to the controller 150. In some other embodiments, at time t1, the second polishing slurry 126, which is maintained at the lower temperature T2, may be also dispensed onto the polishing pad 114 through the conduit 128 to saturate the polishing pad 114, but at a relatively small flow rate.

Next, at time "t2," as more of the first polishing slurry 116 is dispensed onto the polishing pad 114 during the CMP process, the pad temperature 201, which is continuously monitored by the temperature sensor 140, may exceed the constant value Tc. In response, the controller 150 may cause the valve 122 to reduce the flow rate of the first polishing slurry 116, and the valve 132 to increase the flow rate of the second polishing slurry 126. As such, from time "t2" to time "t3," the flow rates of the first polishing slurry 116 and second polishing slurry 126 are kept decreasing and increasing, respectively, until the pad temperature 201 is maintained at the contact value Tc for a certain period of time, for example, t3 minus t2. More specifically, when the first polishing slurry 116 and second polishing slurry 126 are both dispensed onto the polishing pad 114, a mixture of the first polishing slurry 116 and second polishing slurry 126 are in present between the sample 103 and the polishing pad 114, which causes the pad temperature 201 to be between the temperatures T1 and T2, according to some embodiments. And when the flow rates of the first polishing slurry 116 and second polishing slurry 126 are concurrently adjusted, the pad temperature 201 can be controlled to maintain at the constant value Tc.

Although in the illustrated embodiment of FIG. 2, the respective flow rates of the first and second polishing slurries 116 and 126 are monotonically increased/decreased, it is noted that the respective flow rates of the first and second polishing slurries 116 and 126 may be non-monotonically changed while remaining within the scope of the present disclosure. For example, in some embodiments, when the temperature sensor 140 detects the pad temperature 201 exceeds the constant value Tc, in response, the controller 150 may decrease the flow rate of the first polishing slurry 116 and increase the flow rate of the second polishing slurry 126, and once the temperature sensor 140 detects the pad temperature 201 drops below the constant value Tc, in response, the controller 150 may increase the flow rate of the first polishing slurry 116 and decrease the flow rate of the second polishing slurry 126. In some alternative embodiments, rather than adjusting the flow rates of the first and second polishing slurries 116 and 126 via the valves 122 and 132, the controller 150 may adjust the temperatures of the reservoirs 120 and 130 that contain the first polishing slurry 116 and second polishing slurry 126, respectively, while remaining within the scope of the present disclosure.

Figure 3:
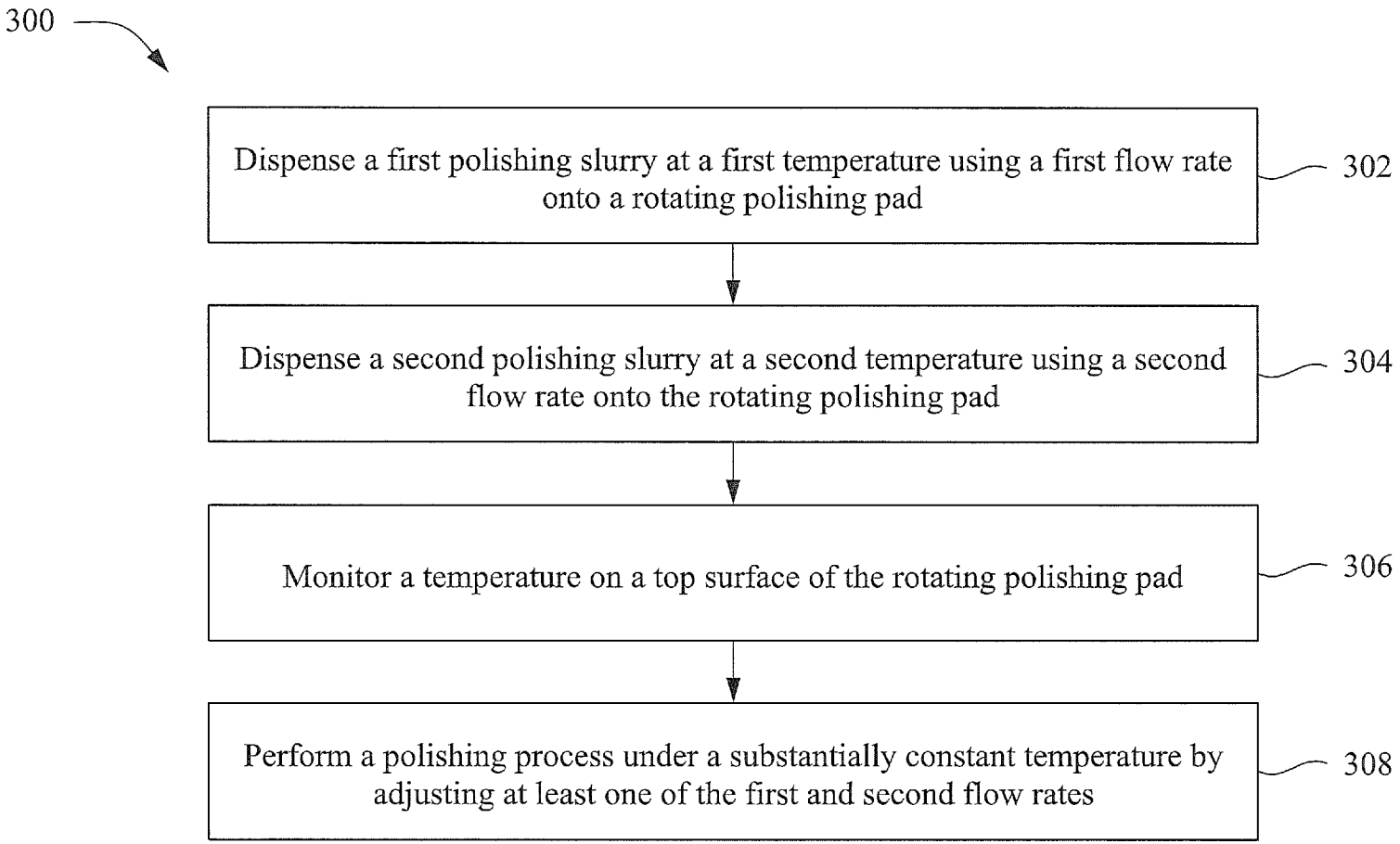
FIG. 3 illustrates a flow chart of an exemplary method to operate the CMP apparatus of FIGS. 1A-1B, in accordance with some embodiments.

FIG. 3 illustrates a flow chart of an exemplary method 300, in accordance with various embodiments of the present disclosure. In various embodiments, the operations of the method 300 are performed by the respective components illustrated in FIGS. 1A-2. For purposes of discussion, the following embodiment of the method 300 will be described in conjunction with FIGS. 1A-2. The illustrated embodiment of the method 300 is merely an example. Therefore, it should be understood that any of a variety of operations may be omitted, re-sequenced, and/or added while remaining within the scope of the present disclosure In some embodiments, the method 300 starts with operation 302 in which a first polishing slurry at a first temperature is dispensed onto a rotating polishing pad using a first flow rate. In the above example, the first polishing slurry 116, which is maintained at the higher temperature T1, is dispensed onto the polishing pad 114 through the conduit 118 in a flow rate adjusted by the valve 122 that is coupled to the conduit 118. Next, the method 300 continued to operation 304 in which a second polishing slurry at a second temperature is dispensed onto the rotating polishing pad using a second flow rate. Continuing with the above example, the second polishing slurry 126, which is maintained at the lower temperature T2, is dispensed onto the polishing pad 114 through the conduit 128 in a flow rate adjusted by the valve 128 that is coupled to the conduit 128. Next, the method 300 continues to operation 306 in which a temperature of the rotating polishing pad is monitored. Continuing with the above example, the temperature of the rotating polishing pad, which is the pad temperature 201, is monitored by the temperature sensor 140, and further reported to the controller 150. Next, the method 300 continues to operation 308 in which a polishing process is performed under a substantially constant temperature by adjusting at least one of the first and second flow rates. Since the pad temperature 201 is dynamically monitored by the controller 150, when the pad temperature 201 exceeds, or drops below, the pre-determined constant temperature Tc, the controller 150 may adjust the valve 122 to control the first flow rate of the first polishing slurry 116 and/or adjust the valve 132 to control the second flow rate of the second polishing slurry 126 so as to maintain the pad temperature 201 substantially close to pre-determined constant temperature Tc, as discussed above.

The foregoing outlines features of several embodiments so that those ordinary skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

In an embodiment, an apparatus for performing a polishing process includes: a rotatable polishing pad; a temperature sensor configured to monitor a temperature on a top surface of the rotatable polishing pad; a first dispenser configured to dispense a first slurry that is maintained at a first temperature on the rotatable polishing pad; and a second dispenser configured to dispense a second slurry that is maintained at a second temperature on the rotatable polishing pad, wherein the second temperature is different from the first temperature so as to maintain the temperature on the top surface of the rotatable polishing pad at a substantially constant value.

In another embodiment, a method includes: dispensing a first slurry at a first temperature using a first flow rate on a rotating polishing pad; dispensing a second slurry at a second temperature using a second flow rate on the rotating polishing pad, wherein the second temperature is different from the first temperature; and performing a polishing process on a sample under a substantially constant temperature by adjusting at least one of the first rate of the first slurry and the second flow rate of the second slurry.

In yet another embodiment, a method includes: dispensing a first slurry with a first temperature using a first flow rate on a polishing pad; dispensing a second slurry with a second temperature using a second flow rate on the polishing pad, wherein the second temperature is different from the first temperature; rotating the polishing pad to polish a sample by holding the sample against the polishing pad in a presence of a mixture of the first and second slurries; monitoring a temperature on a top surface of the polishing pad; and when the temperature is offset from a substantially constant temperature, adjusting at least one of the first and second flow rates so as to maintain the temperature at the substantially constant temperature.

What is claimed is:

1. An apparatus, comprising:

a rotatable polishing pad configured to rotate around a first axis of rotation;

a sample carrier configured to hold a sample to be polished against a top surface of the rotatable polishing pad and rotate the sample around a second axis of rotation parallel to the first axis of rotation, wherein the sample is polished by the top surface of the polishing pad;

a temperature sensor coupled to the top surface of the rotatable polishing pad and configured to monitor a temperature on the top surface of the rotatable polishing pad; and a controller configured to:

dispense a first slurry maintained at a first temperature from a first reservoir at a first flow rate on the rotating polishing pad;

dispense a second slurry maintained at a second temperature using a second flow rate on the rotating polishing pad, wherein the second temperature is lower than the first temperature; and decrease the first flow rate while the second flow rate is increased as a function of polishing time so as to perform a polishing process on the sample under a substantially constant temperature.

2. The apparatus of claim 1, wherein:

the at least one temperature sensor is disposed under the rotatable platen.

3. The apparatus of claim 2, wherein the controller is further configured to:

when the temperature is offset from a pre-defined constant threshold, simultaneously increasing one of the first and second flow rates and decreasing the other of the first and second flow rates until the temperature transitions back to the pre-defined constant threshold.

4. The apparatus of claim 1, wherein the sample is a silicon wafer.

5. The apparatus of claim 1, wherein the controller is further comprising:

maintain the first slurry in the first reservoir at the first temperature; and maintain the second slurry in the second reservoir at the second temperature.

6. The apparatus of claim 1, wherein the polishing process is a chemical mechanical polishing process.

7. The apparatus of claim 1, wherein the first and second slurries have a same abrasive fluid.

8. A apparatus, comprising:

a rotatable polishing pad configured to rotate around a first axis of rotation;

a sample carrier configured to hold a sample to be polished against a top surface of the rotatable polishing pad and rotate the sample around a second axis of rotation parallel to the first axis of rotation, wherein the sample is polished by the top surface of the polishing pad;

a temperature sensor coupled to the top surface of the rotatable polishing pad and configured to monitor a temperature on the top surface of the rotatable polishing pad; and a controller configured to:

dispense a first slurry from a first reservoir at a first flow rate on the rotatable polishing pad;

dispense a second slurry from a second reservoir at a second flow rate on the rotatable polishing pad; and when the temperature is offset from a substantially constant temperature, adjust at least one of the first and second flow rates so as to maintain the temperature at the substantially constant temperature, wherein adjusting at least one of the first and second flow rates comprises simultaneously increasing one of the first and second flow rates and decreasing the other of the first and second flow rates until the temperature transitions back to the substantially constant temperature.

9. The apparatus of claim 8, wherein the sample is a silicon wafer.

10. The apparatus of claim 8, wherein the first and second slurries have a same abrasive fluid.

11. The apparatus of claim 8, wherein the controller is further configured to:

maintain the first slurry at a first temperature in the first reservoir; and maintain the second slurry at a second temperature in the second reservoir.

12. A apparatus, comprising:

a rotatable polishing pad configured to rotate around a first axis of rotation;

a sample carrier configured to hold a sample to be polished against a top surface of the rotatable polishing pad and rotate the sample around a second axis of rotation parallel to the first axis of rotation, wherein the sample is polished by the top surface of the polishing pad;

a controller configured to dispense a first slurry maintained at a first temperature from a first reservoir at a first flow rate on the rotating polishing pad and dispense a second slurry maintained at a second temperature using a second flow rate on the rotating polishing pad, wherein the second temperature is lower than the first temperature; and a temperature sensor coupled to the rotatable polishing pad and configured to monitor a third temperature on a travelling path on the top surface of the rotatable polishing pad, wherein when the third temperature is offset from a substantially constant temperature, the controller is further configured to adjust at least one of the first and second flow rates so as to maintain the third temperature at the substantially constant temperature, and wherein adjusting at least one of the first and second flow rates comprises simultaneously increasing one of the first and second flow rates and decreasing the other of the first and second flow rates until the third temperature transitions back to the substantially constant temperature.

13. The apparatus of claim 12, wherein the controller is further configured to perform a polishing process on the sample while maintaining the third temperature at the substantially constant temperature.

14. The apparatus of claim 12, wherein the temperature sensor is disposed under the rotatable polishing pad.

15. The apparatus of claim 12, wherein the first and second slurries each comprise silica or alumina abrasive particles suspended in either a basic or acidic solution.

16. The apparatus of claim 12, wherein the sample is a silicon wafer.

17. The apparatus of claim 12, wherein the controller is further configured to:

maintain the first slurry at the first temperature in the first reservoir; and maintain the second slurry at the second temperature in the second reservoir.

18. The apparatus of claim 12, wherein the polishing process is a chemical mechanical polishing process.

19. The apparatus of claim 12, wherein the first and second slurries each comprise a same abrasive fluid.

20. The apparatus of claim 12, wherein the first and second slurries comprise different abrasive fluids, respectively.

* * * * *